United States Patent [19]

Poock

[11] Patent Number: 4,544,071

[45] Date of Patent: Oct. 1, 1985

[54] EXTERNAL PENDANT PAY-OUT SYSTEM WITH ANTI-DROOP CONTROL

[75] Inventor: Darwin N. Poock, Cedar Rapids, Iowa

[73] Assignee: FMC Corporation, Chicago, Ill.

[21] Appl. No.: 649,039

[22] Filed: Oct. 29, 1984

Related U.S. Application Data

[62] Division of Ser. No. 393,985, Jun. 30, 1982, Pat. No. 4,492,312.

[51] Int. Cl.[4] ..... B66C 23/04; B66C 23/56; B66C 7/00

[52] U.S. Cl. ..... 212/264; 212/261; 212/262; 212/227; 212/231; 212/239; 212/186; 212/268

[58] Field of Search ..... 212/151, 153, 159, 222, 212/255, 230–232, 264, 266–268

[56] References Cited

U.S. PATENT DOCUMENTS

| | | | |
|---|---|---|---|
| 1,163,497 | 12/1915 | Andersen | 212/264 |
| 2,030,529 | 12/1936 | Nash | 212/153 |
| 2,603,362 | 7/1952 | Wilson | 212/266 |
| 2,698,096 | 12/1954 | Hughes | 212/267 |
| 2,868,392 | 1/1959 | Poffenberger | 212/8 |
| 2,999,600 | 9/1961 | Gates | 212/55 |
| 3,029,954 | 4/1962 | Grant | 212/264 |
| 3,194,413 | 7/1965 | Landry | 212/264 |
| 3,308,967 | 3/1967 | Barkley et al. | 212/55 |
| 3,371,799 | 3/1968 | Brownell et al. | 212/35 |
| 3,465,899 | 9/1969 | Reuter et al. | 212/267 |
| 3,727,359 | 4/1973 | Vonck | 52/121 |
| 3,735,876 | 5/1973 | Brownell et al. | 212/151 |
| 3,740,534 | 6/1973 | Kezer et al. | 340/685 |
| 3,833,130 | 9/1974 | Gerdes et al. | 340/685 |
| 3,856,151 | 12/1974 | Lamer | 212/55 |
| 4,053,058 | 10/1977 | Jensen et al. | 212/8 |
| 4,133,411 | 1/1979 | Curb | 182/2 |
| 4,156,331 | 5/1979 | Lester et al. | 52/115 |
| 4,222,491 | 9/1980 | Geppert | 212/153 |
| 4,392,573 | 7/1983 | Gyomrey | 212/267 |

*Primary Examiner*—Trygve M. Blix
*Assistant Examiner*—R. B. Johnson
*Attorney, Agent, or Firm*—A. J. Moore; H. M. Stanley; R. B. Megley

[57] ABSTRACT

An apparatus is disclosed for maintaining a predetermined mast-boom working angle of a pendant supported boom substantially constant during extension and retraction of the boom. One embodiment of the invention includes control means connected between the boom and the mast for detecting slight angular changes and actuating power means for paying out or drawing in sufficient pendant to return the mast-boom angle to a predetermined angle. Another embodiment utilizes electrical controls having a first potentiometer capable of detecting linear changes in the effective boom supporting length of the pendant and another potentiometer for detecting linear changes in the length of the boom, said potentiometer sending output signal ratios which vary from a predetermined output signal ratio for actuating power means that takes up or pays out sufficient pendant to return the boom to the predetermined mast-boom working angle and returns the output signal ratio to said predetermined ratio.

5 Claims, 10 Drawing Figures

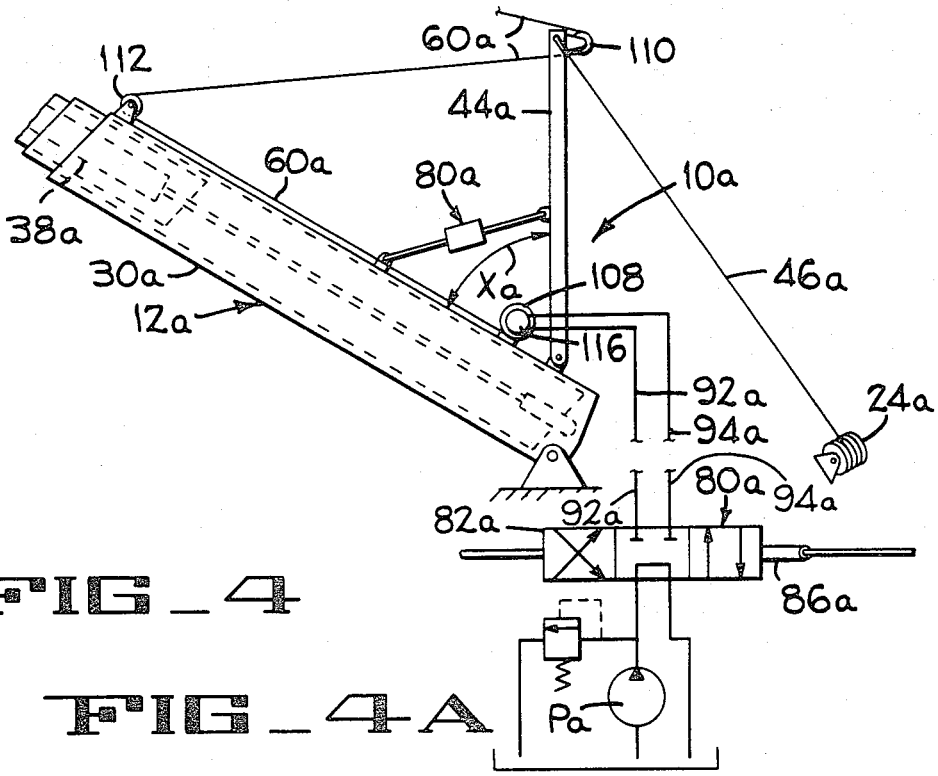
FIG_4
FIG_4A
FIG_6
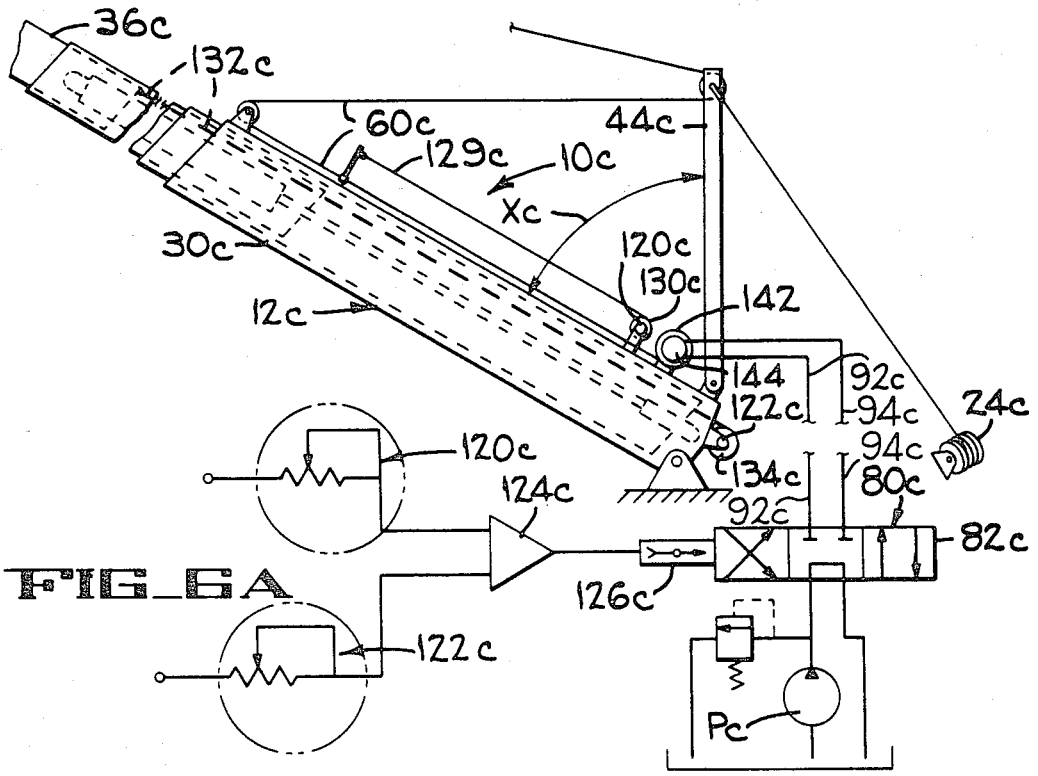
FIG_6A

EXTERNAL PENDANT PAY-OUT SYSTEM WITH ANTI-DROOP CONTROL

CROSS REFERENCE TO RELATED APPLICATIONS

This application is a division of application Ser. No. 393,985 filed June 30, 1982, now U.S. Pat. No. 4,492,312.

The present invention is related to the inventions disclosed in the following copending applications assigned to the assignee of the present invention.

Poock Application Ser. No. 145,529, which was filed on May 1, 1980 entitled, Pendant Supported Hydraulic Extensible Boom now Pat. No. 4,352,434, which issued on Oct. 5, 1982.

Cozad Application Ser. No. 293,727, which was filed on Aug. 17, 1981 and is entitled Low Droop Multi-Part Pendant Supported Boom.

Poock et al Application Ser. No. 393,986 entitled Floating Sheave Type Pendant Pay-Out System For Pendant Supported Boom.

Scherman Application now Pat. No. 4,460,098 which issued on July 17, 1984 entitled Pendant Control System For Pendant Supported Boom.

White Application Ser. No. 393,983 entitled Pendant Supported Boom With Fixed And Live Pendant Portions.

Rathe Application Ser. No. 273,729 filed on Aug., 17, 1981 and entitled Coupling And Latching Mechanism For Extensible Boom.

BACKGROUND OF THE INVENTION

1. Field of the Invention

The present invention relates to multi-section pendant supported telescopic booms and more particularly relates to a pendant pay-out or control system for preventing the boom from pivoting upwardly due to extension of the boom and downwardly due to retraction of the boom.

2. Description of the Prior Art

Multi-section, pendant supported telescopic booms for cranes or the like are well known in the art. It is also well known that such booms may be supported by pendant ropes that are located entirely externally of the boom, or may be of the type that have external pendant portions as well as internal pendant portions that are reaved around sheaves within the boom. Booms of the type having only external pendant ropes that are attached to, or near, the tip end of the boom and are trained over the upper end of a mast pivoted to the boom, or pivoted to the upper crane works, tend to raise the boom tip and decrease the angle between the mast and the boom in response to extension of the boom; and tend to lower the boom tip and to increase said angle in response to retraction of the multi-section boom.

The types of booms which are supported by pendants having both internal and external pendant portions such as disposed in the aforementioned Cozad application, operate in a reverse manner, i.e., the tip of the boom drops when extended and raises when retracted.

It is also well known in the art to extend and retract several sections of a multi-section boom with one or two hydraulic rams. U.S. Pat. No. 4,156,331, which issued to Lester et al on May 29, 1979 illustrates such a boom which uses two rams; and U.S. Pat. 4,133,411 which issued to Curb on Jan. 9, 1979 illustrates a boom operated by a single ram.

SUMMARY OF THE INVENTION

In accordance with the present invention a pendant pay-out or control system is disclosed which will maintain the angle between the boom and mast substantially constant during extension and retraction of the multi-section boom during normal operating conditions, and which will fold a mast against a boom and maintain the pendant lines tight when the boom has been lowered to its transport position.

BRIEF DESCRIPTION OF THE DRAWINGS

FIG. 3A is a diagrammatic hydraulic circuit which includes the portion of the anti-droop detector.

FIG. 4A is a diagrammatic illustration of a hydraulic circuit associated with the droop detector of the FIG. 4 embodiment.

FIG. 6 is a diagrammatic elevation of a fourth embodiment of the system, which embodiment is similar to the third embodiment of the invention except that a hydraulic pendant winch is substituted for the hydraulic cylinder of the FIG. 5 embodiment.

FIG. 6A is a diagrammatic illustration of a combined hydraulic and electrical circuit associated with the droop detector of the FIG. 6 embodiment.

DESCRIPTION OF THE PREFERRED EMBODIMENT

Figures 1, 2:
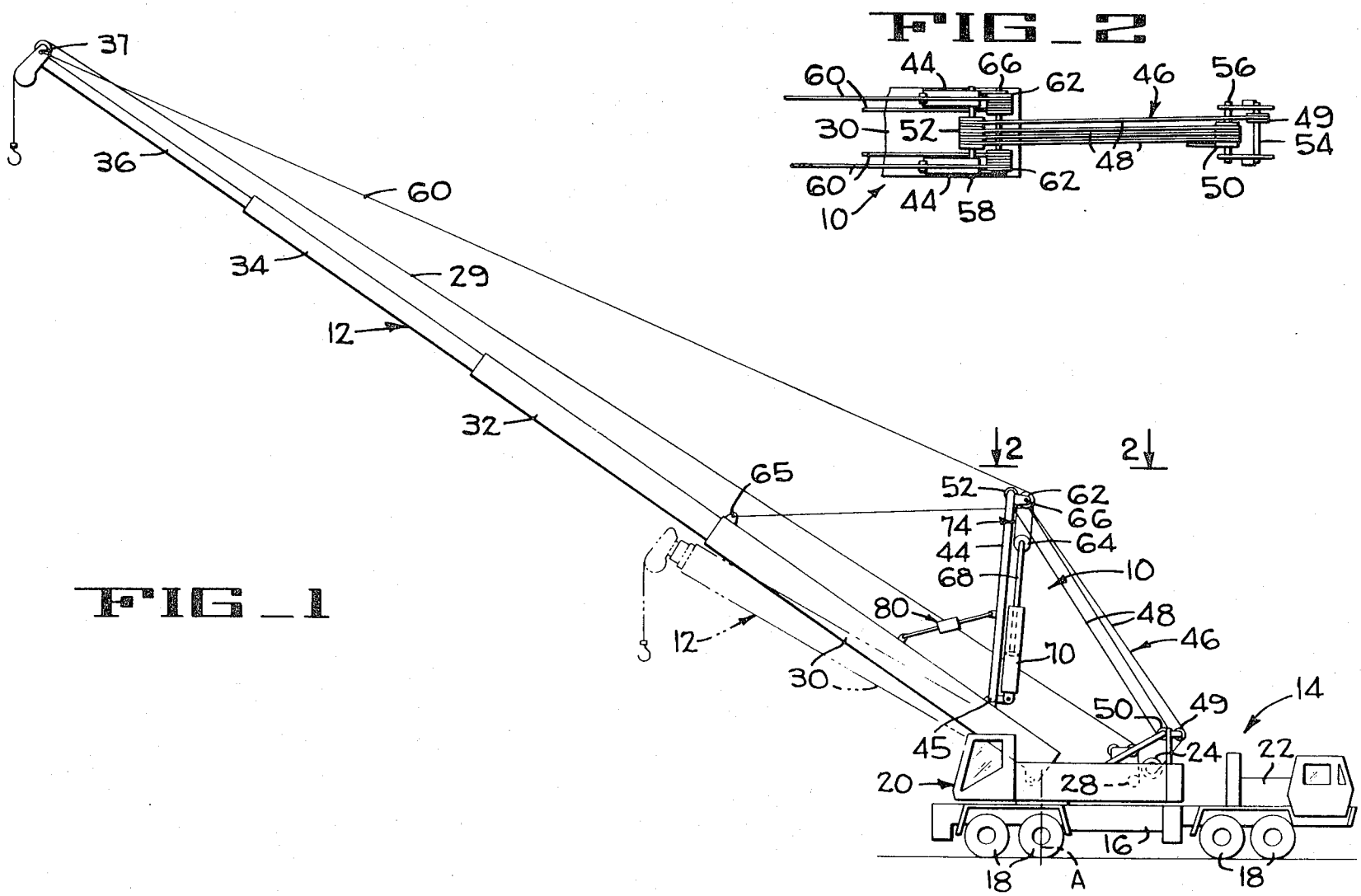
FIG. 1 is a diagrammatic side elevation of a crane illustrating a boom supported by external pendant lines in an extended operative position; the dotted line position illustrating the direction the boom will droop due to retraction if the anti-droop system is inoperative, it being understood however that the tip of the illustrated boom would rest on ground if fully retracted.
FIG. 2 is an enlarged plan looking in the direction of arrows 2—2 of FIG. 1 illustrating the boom hoist and pendant connection to the mast.

The pendant pay-out or control system 10 (FIG. 1) of the first embodiment of the present invention is illustrated in conjunction with a multi-section extensible boom 12 of a mobile crane 14. The crane 14 includes a chassis 16 supported on wheels 18 with an upper works 20 mounted for rotation on the chassis 16 about a vertical axis A. The crane includes an engine 22 which provides power for driving at least some of the wheels 18, for rotating the upper works 20, and for driving hydraulic pumps and motors (to be described hereinafter) which provide power for several winches including a boom supporting winch 24 and a load line winch 28. The load line winch 28 is provided to raise and lower a load attached to the line 29 that is trained over the outer end of the boom.

The boom 12 is illustrated as a four section boom that is supported by two external pendants, which boom includes a base section 30 pivoted to the upper works 20 about a horizontal axis, a manual section 32, an intermediate section 34 and a tip section 36. The four boom sections are telescopically received within each other in a manner conventional in the art. Also, the boom sections may be extended and retracted in a manner conventional in the art. For example, the boom sections may be extended and retracted with a single hydraulic ram 38 (FIG. 3) in the manner fully disclosed in the cross-referenced Rathe application Ser. No. 273,729. The disclosure of the Rathe application is incorporated by reference herein.

A mast 44 is pivotally supported by the upper works 20 preferably at 45 to the base section 30 near the inner end thereof and preferably includes two spaced legs as illustrated in FIG. 2. However, if desired, the mast 44 may be pivoted directly to the upper works 20. The boom supporting winch 24 is connected to the upper end of the mast 44 by a hoist 46 having a multi-part wire rope system 48 trained around a single sheave 49 and around multi-grooved sheaves 50 and 52 (FIG. 2). The single sheave 49 and multi-groove sheave 50 are supported for rotation on the upper works 20 by shafts 54,56. The sheave 52 is supported for rotation on the upper end of the mast 44 by a shaft 58.

At least one pendant rope or line 60 (two being illustrated in FIG. 2) is anchored to the outer end of the tip section 36 at 37 and is trained over sets of sheaves 62,64 (FIG. 1). The pendant line 60 has its other end anchored to the outer end of the base section 30 at 65. The sets of sheaves 62 are secured to a shaft 66 (FIG. 2) journaled on the upper end of the mast 44. The sheaves 64 are journaled on the piston rod 68 (FIG. 1) of a hydraulic pendant take-up cylinder or ram 70 by a shaft 72. The sheaves 62,64 and the portion of the pendant line 60 trained thereover defines a pendant take-up hoist 74.

As mentioned previously, when the boom 12 is supported by fixed length external pendant 60, extension of the boom will cause the tip of the boom to raise due to extension, and to fall due to retraction as indicated in FIG. 1 unless corrected.

Figures 3, 4:
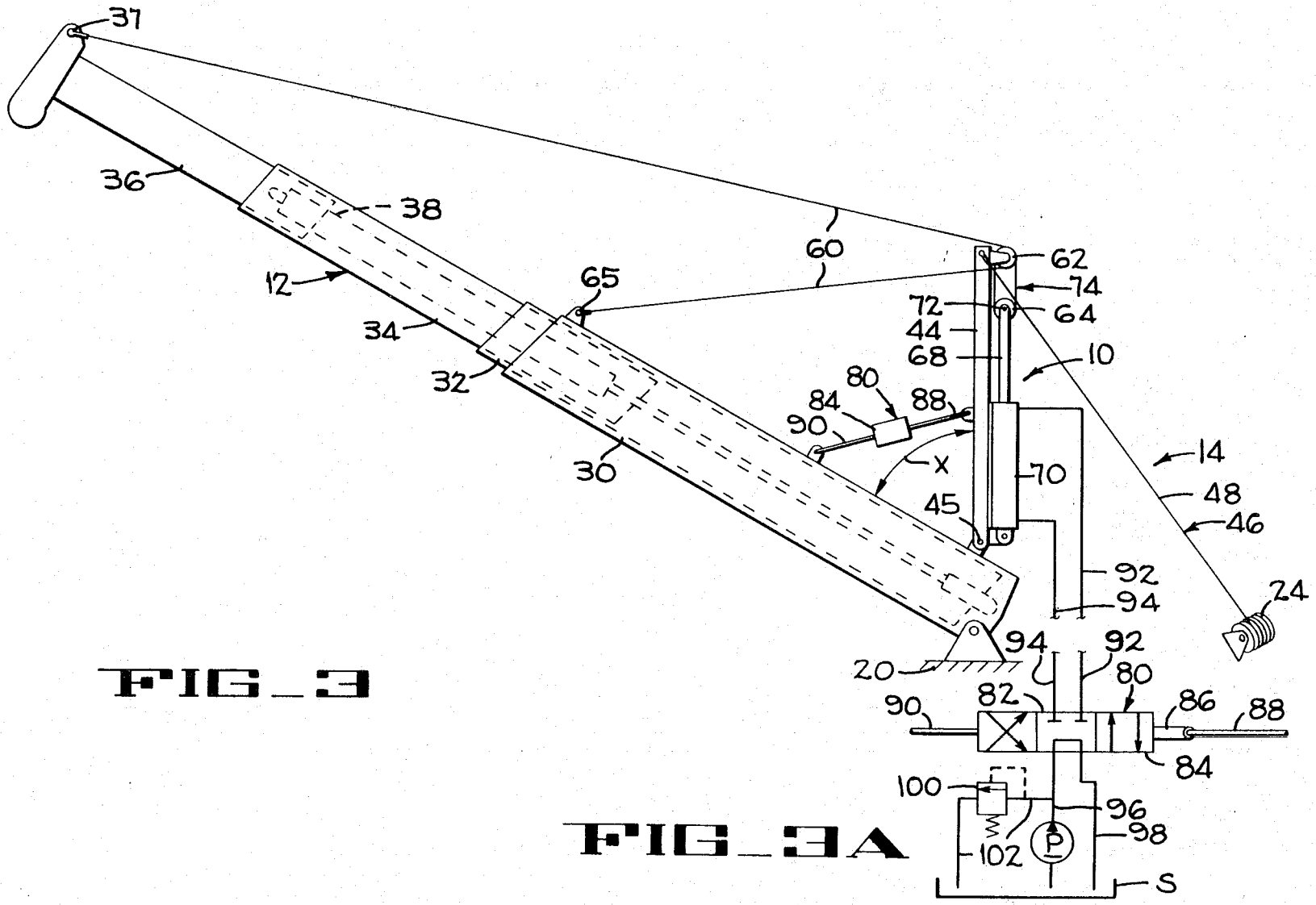
FIG. 3 is a diagrammatic elevation of the boom and a first embodiment of the pay-out system in a partially extended position, the general location of a portion of the first embodiment of said anti-droop control being illustrated in a representative position between the boom and a mast.
FIG. 4 is a diagrammatic section of a portion of the boom and a second embodiment of a pay-out system with the anti-droop control of the first embodiment being connected to a hydraulically driven winch rather than a hydraulic cylinder.

The mast 44 is movable between an inoperative or transport position (not shown) that is parallel to the longitudinal axis of the boom 12, and a boom supporting or working position illustrated in FIGS. 1 and 3. When in the working position it is desirable to maintain a predetermined mast-boom angle X so that the operator need not actuate the boom supporting winch 24 in order to make corrections for maintaining the boom angle constant when extending and retracting the boom.

As best shown in FIG. 3A, an anti-droop detector 80 is connected between the mast 44 and the boom 12 for detecting changes in the mast-boom angle relative to the desired angle X. The anti-droop detector 80 of the first embodiment of the invention includes a four way hydraulic valve 82 having a body 84 and a spool 86 therein. The spool 86 has a center by-pass position, a cross-passage position, and a parallel passage position. The spool 86 is normally maintained in its neutral or by-pass position by springs (not shown) and is pivotally connected to the mast 44 by a rod 88, while the case is pivotally connected to the base section 30 of the boom 12 by another rod 90.

The valve 82 is connected to opposite ends of the pendant take-up hydraulic cylinder 70 by conduits 92,94. A hydraulic pump P draws hydraulic fluid from a sump S and directs the fluid to the valve 82 through conduit 96 for return to the sump through conduit 98. A pressure relief valve 100 is connected by conduit 102 between the output of the pump P and the sump S to provide protection for the pump in a conventional manner.

In operation of the first embodiment of the control system 10, the winch 24 is (FIGS. 1 and 3A) driven in a direction which will raise the mast to its desired working angle and thereafter raise the boom 12 to a working angle as shown in FIG. 3 as is conventional in the art.

When the predetermined mast-boom angle X has been established, the valve 82 is in its centered position thus by-passing the fluid from the pump P directly to the sump S. With the winch 24 held from rotation by a brake (not shown) the operator may extend the boom by operating only the extend-retract control valve (not shown) for the boom extension-retraction cylinder 38 (FIG. 3). Since extension causes the boom tip to tend to raise as mentioned above, the angle X will decrease slightly moving the valve V to its parallel passage position directing fluid through conduit 94 into the cylinder thereby raising the piston rod 68 to pay out pendant line 60 from hoist 74 until the angle X returns to its predetermined position and the valve 82 to its centered position. Thus, the longitudinal axis of the boom 12 is raised only a slight amount above the selected boom angle, i.e., the amount necessary to shift the valve spool 86, and then returns to said predetermined boom angle when extension is completed.

Retraction of the boom 12 tends to cause the axis of the boom to lower such as indicated in dotted lines in FIG. 1. However, a slight lowering of the boom shifts the valve 82 to its cross-passage position thereby directing high pressure fluid into the upper end of the cylinder 70 thus retracting the piston rod 68 and roller 64 thereby hauling in pendant line 60 preventing any substantial drop of the boom 12.

A second embodiment of the pendant pay-out system **10*a* (FIGS. 4 and 4A) is similar to the first embodiment except a hydraulic pendant take-up winch 108 is used in place of the hydraulic cylinder 70 (FIG. 3) and the take-up hoist 74 of the first embodiment of the invention. Accordingly, equivalent parts of the system 10*a* (FIG. 4) will be assigned the same numerals assigned to the pay-out system 10** followed by the letter "a".

The mast **44*a* (FIG. 4) is raised to its desired working angle Xa by the boom supporting winch 24*a* and the hoise 46*a*, and the four way control valve 82*a* of the anti-droop detector 80*a* is pivotally connected between the boom 12*a* and the mast 44*a*** to detect and initiate corrections in the mast-boom angle when different from the predetermined angle Xa.

As in the first embodiment, the outer end of the pendant line **60*a* is anchored to the tip end (not shown) of the boom 12*a*. The pendant line 60*a* is then trained around a single groove sheave 110 journaled on the upper end of the mast 44*a*, a second sheave 112 journaled on the outer end of the base section 30*a* of the boom 12*a*, and is wound on the pendant take-up winch 108. The winch 108 is connected through a conventional spring set—hydraulic release brake to a hydraulic motor 116. The motor 116 is driven in selected direction by high pressure hydraulic fluid from the pump Pa through either the cross-passage or parallel passage positions of the valve 82***a* which valve positions will connect the conduits 92*a*,94*a* to the hydraulic motor 116 of pendant take-up winch 108.

More particularly, when the boom 12*a* is extended by the hydraulic cylinder 38*a* the mast-boom angle will decrease due to a slight raising of the boom causing the spool 86*a* of the valve 82*a* to shift into its parallel passage position thereby driving the winch 108 in a direction which will pay-out pendant line 60*a* until the mast-boom angle returns to its predetermined angle Xa at which time the spool returns to its centered by-pass position.

When the boom is retracted by the hydraulic cylinder 38*a*, the boom will drop slightly, increasing the mast-boom angle and thus shifting the spool of the valve 82*a* to its cross-passage position. Hydraulic fluid flowing through the cross-passages drives the pendant take-up hoist 108 in a haul-in direction thus returning the mast-boom angle to its predetermined angle Xa, thereby centering the valve Va and returning the longitudinal axis of the boom to its selected working angle.

A third embodiment of the pay-out system 10*b* (FIGS. 5 and 5A) is similar to the first embodiment and accordingly parts of the third embodiment that are similar to those of the first embodiment will be assigned the same numerals followed by the letter "b".

The third embodiment differs from the first embodiment in that the hydraulic cylinder 70*b* and the pendant take-up hoist 74*b* are connected to the base section 30*b* of the boom 12*b* rather than to the mast 44*b* as in the first embodiment. Also, the two systems differ in that changes in the mast-boom angle from the predetermined working angles X*b* are electrically detected by a pair of potentiometers 120,122 which initially detect linear changes in the length of the pendant take-up hoist 74*b*, and in the length of boom travel. The signals from the potentiometers 120,122 are sent to a comparator 124 which actuates a servo mechanism 126 of four way control valve 82*b* to haul-in or pay-out pendant line in response to voltage differences from a predetermined proportion or ratio.

Figures 5, 5A:
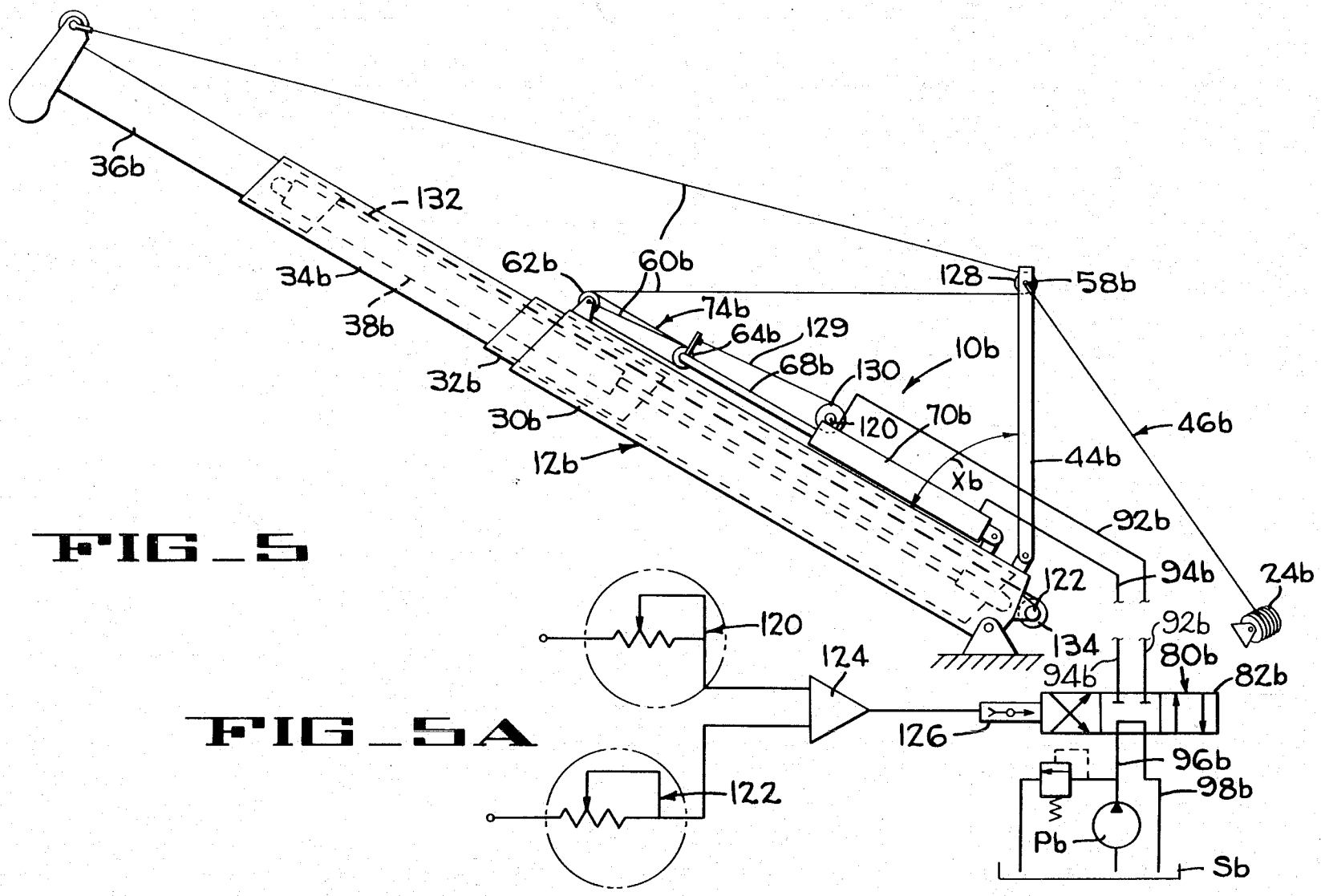
FIG. 5 is a diagrammatic elevation of a third embodiment of the invention which is similar to the FIG. 1 embodiment except that the pay-out system is connected to the boom, and an electrical anti-droop control is provided.
FIG. 5A is a diagrammatic illustration of a combined hydraulic and electrical circuit associated with the droop detector of the FIG. 5 embodiment.

As illustrated in FIG. 5, the winch 24*b* and boom supporting hoist 46*b* has elevated the mast 44*b* and boom 12*b* to a desired working position and a desired mast-boom working angle Xb. One end of the fixed length pendant 60*b* is anchored to the tip end of the tip section 36*b* of the boom 12*b* and is trained around a single groove sheave 128 journaled on the shaft 58*b*. The pendant 60*b* is then trained around the sheaves 62*b*,64*b* of the pendant take-up hoist 74*b* and its other free end is anchored to the shaft of either the sheave 62*b* or 64*b*.

As in the first embodiment of the invention a hydraulic pump Pb draws fluid from a sump Sb and returns it to sump Sb through conduits 96*b*,98*b* when the valve 82*b* is in its illustrated centered or by-pass position. When the valve 82*b* is shifted to the parallel passage position, high pressure fluid is directed through conduits 96*b*,94*b* to extend the piston rod 68*b* thereby paying out pendant line 60*b*. When the valve 82*b* is shifted to the cross-passage position, high pressure fluid is directed through conduits 96*b* and 92*b* thereby hauling in pendant line 60*b*.

The potentiometer 120 is mounted on the cylinder 70*b* and is actuated by a line 129 connected to the outer end of the piston rod 68*b* and to a spring tensioned reel 130 which varies the voltage output of the potentiometer 120 in response to extension or retraction of the piston rod 68*b*.

Similarly, the potentiometer 122 is mounted on the base section 30*b* of the boom 12*b* and is connected to the tip section 36*b* by a line 132 which is wound on a spring loaded reel 134 which varies the output voltage of the potentiometer 122 in response to extension and retraction of a boom 12*b* by selective actuation of the hydraulic cylinder 38*b*.

In operation, extension of the boom 12*b* will pull line 132 off the reel 134 which turns the reel driven potentiometer 122 thereby varying its output voltage, which voltage is sent to the comparator 124. The comparator compares the voltage from the potentiometers 120 and 122 to determine if the voltages are in the proper predetermined proportion. The voltage change from said predetermined proportional voltage causes the comparator to send an output signal to the servo mechanism 126 to shift valve 82*b* to its parallel passage position thereby extending the piston rod and paying pendant line 60*b* off the hoist 74*b* until the mast-boom angle returns to the predetermined working angle Xb, at which time the voltages from potentiometers are in the correct predetermined proportion and no output signal is sent to the servo-mechanism and the valve returns to its centered position.

During retraction of the boom 12*b*, the boom tends to pivot downwardly and thus the mast-boom angle increases slightly from the predetermined angle Xb. This increase in angle is corrected in response to changes in output voltage from potentiometer 122 relative to the output voltage from potentiometer 120. The voltage change of potentiometer 122 occurs due to shortening of the line 132 which is taken up by the spring loaded reel 134 thereby turning the potentiometer 122. The unbalanced signal from the potentiometer 120,122 is sent to the comparator 124 which sends an output signal to the servo mechanism 126 of valve 82*b* thus shifting the valve to its cross-passage position which retracts the piston rod 68*b*. Retraction of the piston rod 68*b* causes the pendant hoist 74*b* to haul in pendant line 60*b* until the two potentiometers return the voltage to the proper predetermined proportion thereby returning the boom 12*b* to its preset working angle without actuating the boom hoist 24*b*.

A fourth embodiment of the pendant pay-out system 10*c* (FIGS. 6 and 6A) is the same as the embodiment 10*b* except a winch 142 that is driven by hydraulic motor 144 through a spring set-hydraulically released brake (not shown) is substituted for the hydraulic cylinder 70*b* and the pendant hoist 74*b*. The potentiometer 120*c* (FIG. 6) is mounted on the base section 30*c* of the boom boom 12*c*. A spring loaded reel 130*c* of the potentiometer 120*c* is connected to the pendant 60*c* by a line 129*c* which changes the voltage output of the potentiometer 120*c* in response to pendant line 60*c* being payed out or hauled in by the winch 142. The potentiometer 122*c* and its spring loaded reel 134*c* are mounted on the base section 30*c*. The line 132*c* is wound on the reel 134*c* and has its free end attached to the tip section 36*c* of the boom 12*c*.

The operation of the fourth embodiment of the take-up system 10*c* is substantially the same as that disclosed in the third embodiment and accordingly will not be fully described. Briefly, if the boom 12*c* is being extended, the line 132 is also extended thereby shifting the potentiometer 122 such that the output voltage from the potentiometer differs from the proper predetermined or preset proportion thereby sending a signal to the comparator 124*c* and servo mechanism 126*c* shifting the valve 82*c* to its parallel passage position. When the valve 82*c* is in its parallel passage position fluid from pump Pc is directed into the motor 144 to drive the winch in a pendant pay-out direction until the proper voltage proportion is again re-established.

In response to retraction of the boom 12*c*, the voltage of the potentiometers is again changed. This difference in voltage from the predetermined proportion or ratio shifts the valve 82*c* into its cross-passage position thereby driving the winch 142 in a pendant take-up direction until the voltages are again returned to said proper predetermined proportion. Thus, the pendant pay-out system 10*c* will maintain the mast-boom angle Xc substantially constant and the working angle of the boom substantially the same when being extended and retracted and without requiring operation of the boom supporting winch 24*c*.

From the foregoing description it is apparent that four embodiments of a pendant pay-out system are disclosed. Each of the embodiments will maintain a pendant supported boom at a substantially constant working angle while being extended and retracted without requiring that an operator also actuate a boom supporting winch for maintaining the boom and live mast in desired position. The first two embodiments of the invention detect slight changes in the mast-boom angle relative to the predetermined working angle for initiating actuation of power means for paying out or hauling in pendant thereby returning the mast-boom angle to its predetermined working angle. The third and fourth embodiments detect changes in the lengths of the boom and the boom supporting portions of the pendant for maintaining the longitudinal axis of the boom substantially constant during extension and retraction thereof without altering the position of the boom winch 24*c*.

Although the best mode contemplated for carrying out the present invention has been herein shown and described, it will be apparent that modification and variation may be made without departing from what is regarded to be the subject matter of the invention.

What is claimed is:

1. A pendant pay-out system for maintaining the working angle of a pendant supported extensible boom substantially constant when the boom is being extended or retracted, said boom being pivoted to support means and including a pivotally supported base section having at least one section telescopically received therein, a live mast supported for pivotal movement relative to said support means and having rotatable pendant supporting means on the free end thereof, and means for pivoting the mast between a lowered position and one of a plurality of raised working positions with one position defining a predetermined mast-boom angle, the improvement which comprises: a pendant trained over said rotatable means on said mast and having one end connected to said one boom section and the other end portion supportively connected to said base section, reversible power operated means for taking up or paying out pendant, control means responsive to extension of the boom for actuating said power means to pay out sufficient pendant and responsive to retraction of the boom for actuating said power means to haul in sufficient pendant to maintain said mast boom angle substantially constant during extension and retraction of the boom, said reversible power operated means being directly connected to said boom, said reversible power means includes hydraulic motor means; and wherein said control means comprises electrical control means including a first potentiometer responsive to linear changes in the amount of pendant being taken in or payed out, a second potentiometer responsive to linear changes due to extension and retraction of the boom, and a comparator for receiving signals from said potentiometers; and wherein said control means also includes a hydraulic valve and a servo mechanism for receiving signals from said comparator for shifting said valve; said potentiometers being preset to provide a predetermined output ratio when said mast-boom angle is at said predetermined working angle, said servo mechanism being responsive to changes in said output ratio from said predetermined ratio due to extension or retraction of the boom to shift the hydraulic valve into positions which drive said motor in a direction which pays out or hauls in pendant until said output ratio returns to said predetermined output ratio.

2. An apparatus according tc claim 1 wherein said hydraulic motor means includes a hydraulic ram and a multi-parts of pendant take-up winch which pays out and draws in pendant line in response to extension and retraction of said hydraulic ram.

3. An apparatus according to claim 2 wherein said hydraulic motor and winch are anchored to said boom.

4. An apparatus according to claim 1 wherein said other end portion of said pendant is trained around a winch and wherein said hydraulic motor is in driving connection with said winch for paying out and hauling in pendant line.

5. An apparatus according to claim 4 wherein said hydraulic winch and motor are connected to said mast.

* * * * *